US006109239A

United States Patent [19]

Watanabe

[11] Patent Number: 6,109,239

[45] Date of Patent: Aug. 29, 2000

[54] VEHICLE DRIVE POWER CONTROL APPARATUS

[75] Inventor: Shinji Watanabe, Tokyo, Japan

[73] Assignee: Mitsubishi Denki Kabushiki Kaisha, Tokyo, Japan

[21] Appl. No.: 09/298,909

[22] Filed: Apr. 26, 1999

[30] Foreign Application Priority Data

Oct. 26, 1998 [JP] Japan ..... 10-304190

[51] Int. Cl.[7] ..... F02D 41/22

[52] U.S. Cl. ..... 123/396; 123/399

[58] Field of Search ..... 123/198 D, 361, 123/396, 397, 399, 479; 73/118.1; 701/29, 35, 101, 102

[56] References Cited

U.S. PATENT DOCUMENTS

| | | | |
|---|---|---|---|
| 4,603,675 | 8/1986 | Junginger et al. | 123/478 |
| 5,339,782 | 8/1994 | Golzer et al. | 123/399 |
| 5,429,092 | 7/1995 | Kamei | 123/399 |
| 5,447,134 | 9/1995 | Yokoyama | 123/399 |
| 5,553,581 | 9/1996 | Hirabayashi et al. | 123/399 |
| 5,602,732 | 2/1997 | Nichols et al. | 123/399 |
| 5,950,597 | 9/1999 | Kamio et al. | 123/399 |
| 5,983,859 | 11/1999 | Bruedigam et al. | 123/396 |
| 5,983,860 | 11/1999 | Kitamura et al. | 123/399 |
| 6,047,679 | 4/2000 | Matsumoto et al. | 123/396 |

FOREIGN PATENT DOCUMENTS

| | | |
|---|---|---|
| 59-65520 | 4/1984 | Japan . |
| 5-202793 | 8/1993 | Japan . |
| 6-94820 | 11/1994 | Japan . |

*Primary Examiner*—Willis R. Wolfe
*Attorney, Agent, or Firm*—Sughrue, Mion, Zinn, Macpeak & Seas, PLLC

[57] ABSTRACT

In a vehicle drive power control apparatus of the present invention, an output of a first throttle valve opening detection means 61 and an output of a first accelerator opening detector 51 are inputted into a first control unit 2. Further, an output of a second throttle valve opening detection means 62 and an output of a second accelerator opening detector 52 are inputted into a second control unit 3. In addition, the vehicle drive power control apparatus comprises first and second throttle opening detection failure decision units deciding a failure of the first and second throttle opening detection means 34, 35, and communication failure decision means 33 deciding a failure of communication means between the first and second control units 2, 3. Furthermore, the vehicle drive power control apparatus switches each failure decision method of the first and second throttle opening detection failure decision means 34, 35 according to the decision results of respective failure decision means.

14 Claims, 10 Drawing Sheets

VEHICLE DRIVE POWER CONTROL APPARATUS

BACKGROUND OF THE INVENTION

1. Field of the Invention

The present invention relates to a vehicle drive power control apparatus controlling a drive power of an engine by driving a throttle valve, installed in an inlet pipe of a vehicle engine, with an electric signal, and in particular, to an apparatus detecting a failure of means for detecting an opening of the throttle valve.

2. Description of Related Art

In a usual automobile, a throttle valve is provided in a path of intake air for an engine. The throttle valve is opened and closed with interlocking with the operation of an accelerator pedal by a driver. The intake air volume in the engine is controlled according to a manipulated variable of an accelerator pedal.

This intake air volume control is achieved by making the throttle valve and accelerator pedal interlock with each other by mechanical connection means such as a link and a wire. Nevertheless, such mechanical connection means has a problem that there is no degree of freedom since the relation between an accelerator-depressing amount and the throttle valve opening is determined uniquely, and that the degree of freedom of a mounting position becomes small since the positional relation between the accelerator pedal and throttle valve is restricted.

Furthermore, recently, in a vehicle where control by a constant speed control apparatus, a traction control apparatus, and the like are applied, it is necessary to control the throttle valve regardless of the accelerator operation by a driver. Therefore, it has been attempted to electrically connect the throttle valve to a motor and the like and to control the throttle valve. In such an apparatus, it is necessary to sufficiently pay attention to safety in particular. In a complicated construction, a failure rate also inevitably increases as the number of components increases.

As a this kind of technology, for example, "Apparatus controlling vehicle drive power" described in Japanese Patent Laid-Open No. 5-202793 discloses the followings. This apparatus comprises at least two control units (a first control unit and a second control unit) controlling at least two variable amounts which make the drive power change and are independent of each other, and at least one measuring device detecting drive variables of a drive unit and/or the vehicle. In addition, the measuring device comprises at least two redundant sensors, an output signal of one sensor is inputted to the first control unit, and an output signal of the other sensor is inputted to the second control unit.

Both control units monitor the measuring device on the basis of the output signals of the sensors. Monitoring-results of both control units are compared by either of both control units. If the compared result is not "coincidence", emergency run is performed after a predetermined time with limiting the power. If the compared result is "coincidence", the failed sensor is identified and a control function is performed on the basis of the sensor not failed.

BRIEF SUMMARY OF THE INVENTION

Object of the Invention

In a vehicle drive power control apparatus that drives and controls a throttle valve with an electric signal, a failure of throttle opening detection means may lead to excessive increase of an engine speed and excessive acceleration of a vehicle.

Nevertheless, the publication of the conventional apparatus does not refer to a failure detection method of two redundant sensors at the time of a failure of communication between the first and second control units. Therefore, the conventional apparatus has a problem of not being able to secure safety for driving the vehicle more safely.

The present invention is performed to solve such above problems, and an object of the present invention is to provide a vehicle drive power control apparatus that has two control units, the vehicle drive power control apparatus which detect a failure of a throttle opening detection means, composed of two redundant sensors, with simple detection logic and can secure safety driving of a vehicle by detecting a failure rapidly and accurately without increasing cost.

SUMMARY OF THE INVENTION

A vehicle drive power control apparatus according to a first form of the present invention sent invention comprises: a throttle valve adjusting the volume of intake air to an engine; first and second throttle opening detection means detecting an opening of the throttle valve; throttle drive means driving the throttle valve with an electric signal; first and second accelerator opening detection means detecting a position of an accelerator pedal as an accelerator opening; a first control unit calculating control parameters for the engine according to operation conditions shown by outputs from the first accelerator opening detection means and first throttle opening detection means; a second control unit calculating controlled-variables of the throttle drive means on the basis of a target throttle opening included in the controlled-variables and outputs from the second accelerator opening detection means and second throttle opening detection means; communication means performing information communication between the first control unit and second control unit; communication failure decision means deciding a failure of the communication means; first and second throttle opening detection failure decision means deciding a failure of the first and second throttle opening detection means; and failure decision method switching means switching a failure decision method of the first and second throttle opening detection failure decision means according to the decision result of the communication failure decision means or decision results of the first and second throttle opening detection failure decision means.

A vehicle drive power control apparatus according to a second form of the present invention has a communication failure decision means provided in the second control unit.

A vehicle drive power control apparatus according to a third form of the present invention has such a construction that failure decision method switching means decides that the second throttle opening detection means is failed, if the communication failure decision means does not decide that communication from the first control unit to the second control unit is failed, an output of the second throttle opening detection means is equal to or more than a sixth predetermined opening value that is the largest in outputs, an output of the first throttle opening detection means is equal to or more than a fifth predetermined opening value that is lower then the sixth predetermined opening value, and these conditions are continued for a first predetermined time.

A vehicle drive power control apparatus according to a fourth form of the present invention has such a construction that failure decision method switching means decides that the second throttle opening detection means is failed, if the communication failure decision means decides that communication from the first control unit to the second control unit is failed, an output of the second throttle opening detection means is equal to or more than the sixth predetermined opening value, and these conditions are continued for the first predetermined time.

A vehicle drive power control apparatus according to a fifth form of the present invention has such a construction that failure decision method switching means decides that the second throttle opening detection means is failed, if an output of the second throttle opening detection means is equal to or less than a first predetermined opening value that is the smallest in outputs, and this condition is continued for the first predetermined time.

A vehicle drive power control apparatus according to a sixth form of the present invention has such a construction that failure decision method switching means decides that the first throttle opening detection means is failed, if the communication failure decision means does not decide that communication from the first control unit to the second control unit is failed, a target throttle opening, which is calculated by the first control unit on the basis of an output of the first accelerator opening detection means and is transmitted to the second control unit by the second control unit, is equal to or less than a fourth predetermined opening value that is lower than the fifth predetermined opening value, an output of the first throttle opening detection means is equal to or less than a second predetermined opening value that is lower then the fourth predetermined opening value, and these conditions are continued for a third predetermined time.

A vehicle drive power control apparatus according to a seventh form of the present invention has such a construction that failure decision method switching means decides that the first throttle opening detection means is failed, if the communication failure decision means does not decide that communication from the first control unit to the second control unit is failed, or if the second throttle opening detection failure decision means does not decide to be a failure, an output of the first throttle opening detection means is equal to or more than the sixth predetermined opening value, an output of the second throttle opening detection means is equal to or more than a third predetermined opening value that is lower then the fourth predetermined opening value, and these conditions are continued for the third predetermined time.

A vehicle drive power control apparatus according to an eighth form of the present invention has such a construction that failure decision method switching means decides that the first throttle opening detection means is failed, if the communication failure decision means does not decide that communication from the first control unit to the second control unit is failed and the second throttle opening detection failure decision means decides to be a failure, an output of the first throttle opening detection means is equal to or more than the first predetermined opening value, and these conditions are continued for the third predetermined time.

A vehicle drive power control apparatus according to a ninth form of the present invention has such a construction that failure decision method switching means decides that the second throttle opening detection means is failed, if the communication failure decision means does not decide that communication from the first control unit to the second control unit is failed, an opening deviation between the target opening and an output of the second throttle opening detection means is equal to or more than a predetermined value in a period which starts from the time of the change of the target opening being to the extent equal to or more than a predetermined value and excludes the fourth predetermined time, an opening deviation between an output of the second throttle opening detection means and an output of the first throttle opening detection means is equal to or more than a predetermined value, and these conditions are continued for the second predetermined time.

A vehicle drive power control apparatus according to a tenth form of the present invention has such a construction that failure decision method switching means decides that a characteristic of the throttle opening detection means is abnormal, if an output characteristic of the first throttle opening detection means and an output characteristic of the second throttle opening detection means are inverse in regard to the throttle opening, the communication failure decision means does not decide that communication from the first control unit to the second control unit is failed, the sum of an output value of the first throttle opening detection means and an output value of the second throttle opening detection means is present out of a predetermined value range, and these conditions are continued for the fifth predetermined time.

A vehicle drive power control apparatus according to an eleventh form of the present invention has such a construction that failure decision method switching means controls a throttle opening with switching to the first throttle opening detection means if the second throttle opening detection failure decision means decides to be a failure while the failure decision method switching means controls the throttle opening on the basis of an output of the second throttle opening detection means.

A vehicle drive power control apparatus according to a twelfth form of the present invention has such a construction that failure decision method switching means makes a driver recognize a failure of the apparatus with failure warning means if it is decided that either of the first throttle opening detection means or second throttle opening detection means is failed.

A vehicle drive power control apparatus according to a thirteenth form of the present invention has such a construction that failure decision method switching means controls a throttle valve on the basis of an accelerator opening value, which is limited to a product of an output value of the accelerator opening detection means and a first predetermined coefficient, if it is decided that either of the first throttle opening detection means or second throttle opening detection means is failed.

A vehicle drive power control apparatus according to a fourteenth form of the present invention has such a construction that failure decision method switching means controls a throttle valve on the basis of an accelerator opening value, which is limited to a product of an output value of the second accelerator opening detection means and a first predetermined coefficient by the second control unit, if the communication failure decision means decides that communication from the first throttle opening detection means to the second throttle opening detection means is failed.

DETAILED DESCRIPTION OF THE PREFERRED EMBODIMENTS

Embodiment 1

An Embodiment 1 of the present invention will be described below with reference to drawings.

Figure 1:
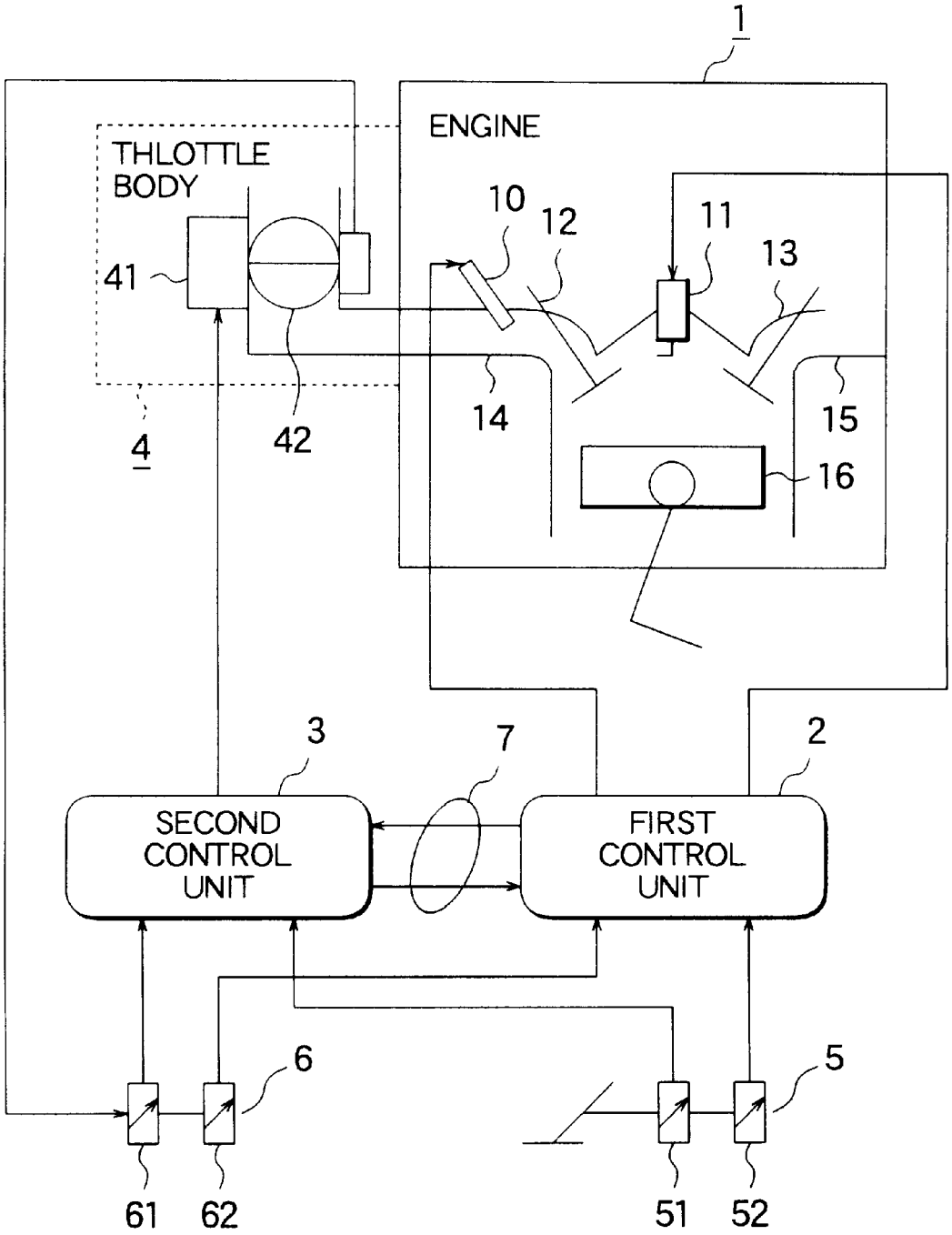
FIG. 1 is a diagram showing a schematic construction of a vehicle drive power control apparatus of the present invention.

FIG. 1 is a diagram showing a schematic construction of a vehicle drive power control apparatus according to this embodiment.

In FIG. 1, an engine 1 mounted in a vehicle comprises a fuel injection valve 10, a spark plug 11, an inlet valve 12, an exhaust valve 13, an inlet pipe 14, an exhaust pipe 15, and a piston 16.

A throttle valve 42 and throttle drive means 41 such as a DC motor driving the throttle valve 42 with an electric signal are built in a throttle body 4 installed in the inlet pipe 14 of the engine 1. Furthermore, throttle opening detection means 6 detecting an opening of the throttle valve 42 with detection signals from a first throttle opening detection means 61 and a second throttle opening detection means 62 is also built in the throttle body.

In addition, accelerator opening detection means 5 detects a position of an accelerator pedal as an accelerator opening and comprises a first accelerator opening detection means 51 and a second accelerator opening detection means 52.

A first control unit 2 calculates control parameters for the engine 1 according to operation conditions including the accelerator opening and throttle opening. A second control unit 3 calculates manipulated-variables for the throttle drive means 41 on the basis of a target throttle opening included in the control parameters calculated by the first control unit 2.

Communication means 7 performs information communication between the first control unit 2 and second control unit 3 (failure information is transmitted from the second control unit 3 to the first control unit 2).

An output of the first throttle opening detection means 61 and an output of the first acceleration opening detection means 51 are inputted to the first control unit 2. An output of the second throttle opening detection means 62 and an output of the second acceleration opening detection means 52 are inputted to the second control unit 3.

Figure 2:
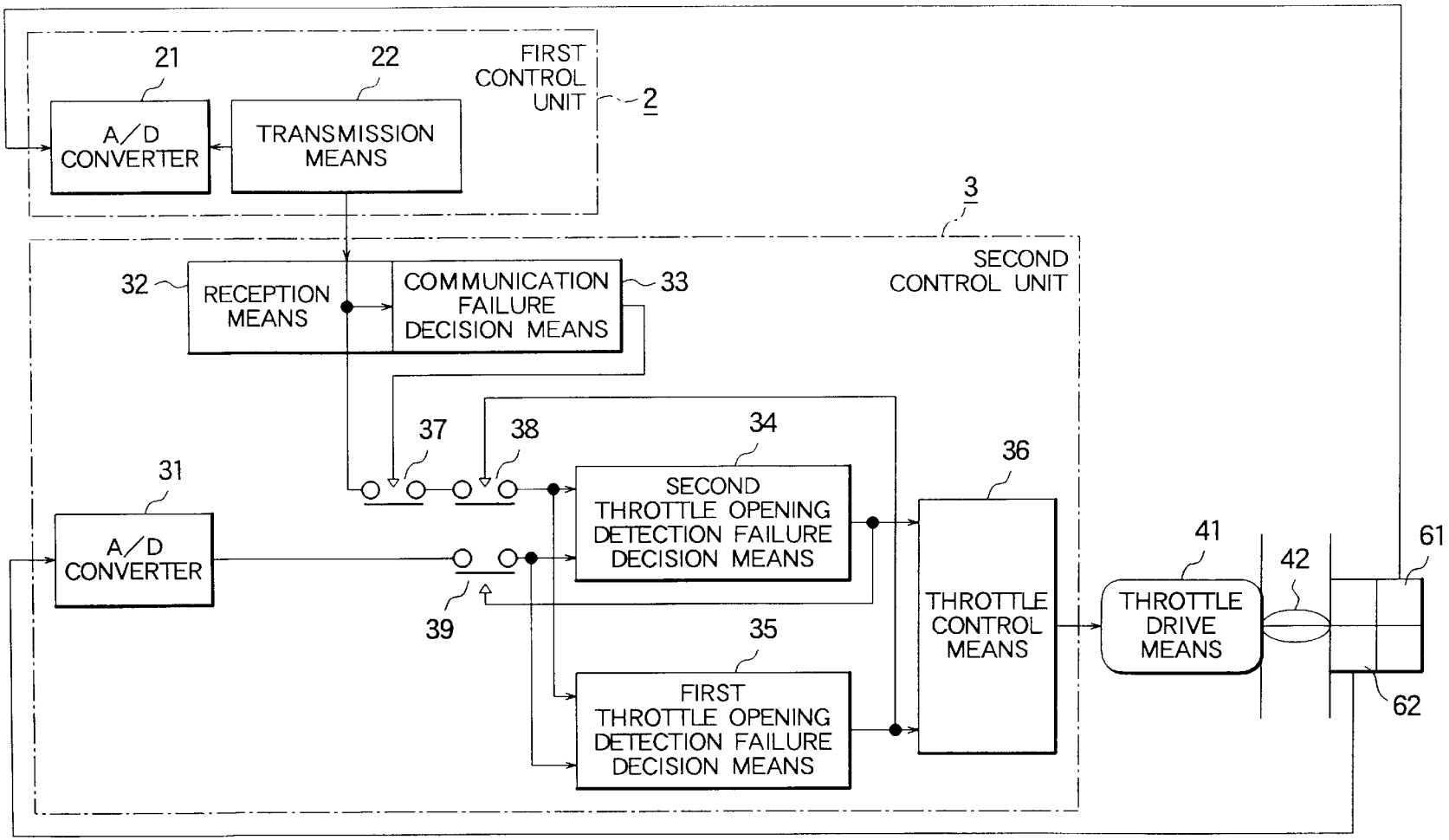
FIG. 2 is a block diagram showing a failure detection method of throttle opening detection means.

FIG. 2 is a block diagram explaining detection logic of a failure of the first and second throttle opening detection means 61 and 62 in the second control unit 3.

In FIG. 2, the first control unit 2 comprises: an A/D converter 21 converting a first throttle opening voltage signal $V_{tps1}$, detected by the first throttle opening detection means 61, into a digital amount; and transmission means 22 transmitting the first throttle opening voltage signal $V_{tps1}$, which is A/D-converted, to the second control unit 3.

The second control unit 3 comprises: an A/D converter 31 converting a second throttle opening voltage signal $V_{tps2}$, detected by the second throttle opening detection means 62, into a digital amount; reception means 32 receiving the first throttle opening voltage signal $V_{tps1}$ transmitted from the first control unit 2; communication failure decision means 33 deciding a communication failure from the first throttle opening voltage signal $V_{tps1}$ that is received; second throttle opening detection failure decision means 34 receiving the first throttle opening voltage signal $V_{tps1}$, which is received by the reception means 32, and the second throttle opening voltage signal $V_{tps2}$, which is A/D-converted, and deciding a failure of the second throttle opening detection means 62; first throttle opening detection failure decision means 35 receiving the first throttle opening voltage signal $V_{tps1}$, which is received by the reception means 32, and the second throttle opening voltage signal $V_{tps2}$, which is A/D-converted, and deciding a failure of the first throttle opening detection means 61; throttle control means 36 selecting an actual throttle opening voltage signal $V_{tps}$, which is used in throttle opening control for the throttle drive means 41, from between the first and second throttle opening voltage signals $V_{tps1}$ and $V_{tps2}$ on the basis of decision results of the first and second throttle opening detection failure decision means 35 and 34; a shut-off switch 37 that is inserted in series to a signal line between the reception means 32 and second throttle opening detection failure decision means 34 and shuts off a signal when the communication failure decision means 33 decides to be a communication failure; a shut-off switch 38 that is connected in series to the shut-off switch 37 and shuts off a signal when the first throttle opening detection failure decision means 35 decides that the first throttle opening detection means 61 is failed; and a shut-off switch 39 that is connected in series to a signal line between the A/D converter 31 and an input side of the first throttle opening detection failure decision means 35 and shuts off a signal when the second throttle opening detection failure decision means 34 decides that the second throttle opening detection means 62 is failed.

Next, the failure detection logic will be described.

The first throttle opening voltage signal $V_{tps1}$, which is detected by the first throttle opening detection means 61, is converted by the A/D converter 21 of the first control unit 2 into a digital amount and is transmitted to the second control unit 3 through the transmission means 22. The first throttle opening voltage signal $V_{tps1}$, which is received by the reception means 32 of the second control unit 3, is inputted to the first and second throttle opening detection failure decision means 35 and 34 through the shut-off switches 37 and 38.

On the other hand, the second throttle opening voltage signal $V_{tps2}$, which is detected by the second throttle opening detection means 62, is converted by the A/D converter 31 of the second control unit 3 into a digital amount and is inputted to the first and second throttle opening detection failure decision means 35 and 34 through the shut-off switch 39.

If the communication failure decision means 33 decides to be a communication failure, the shut-off switch 37 shuts off the first throttle opening voltage signal $V_{tps1}$ inputted to the first and second throttle opening detection failure decision means 35 and 34.

If the first throttle opening detection failure decision means 35 decides to be a failure of the first throttle opening detection means 61, the shut-off switch 38 shuts off the first throttle opening voltage signal $V_{tps1}$ inputted to the first and second throttle opening detection failure decision means 35 and 34.

If the second throttle opening detection failure decision means 34 decides to be a failure of the second throttle opening detection means 62, the shut-off switch 39 shuts off the second throttle opening voltage signal $V_{tps2}$ inputted to the first and second throttle opening detection failure decision means 35 and 34.

The first and second throttle opening voltage signals $V_{tps1}$ and $V_{tps2}$ are inputted to the throttle control means 36 through the first and second throttle opening detection failure decision means 35 and 34.

The throttle control means 36 selects an actual throttle opening voltage signal $V_{tps}$, which is used in throttle opening control, from between the first and second throttle opening voltage signals $V_{tps1}$ and $V_{tps2}$ on the basis of decision results of the first and second throttle opening detection failure decision means 35 and 34.

Furthermore, when a signal to be the actual throttle opening voltage signal $V_{tps}$ is decided, the throttle control means 36 performs throttle opening control by calculating manipulated variables for the throttle drive means 41 with position feedback control (for example, PID control) calculation so that the actual throttle opening voltage signal $V_{tps}$ may coincide with a target throttle opening voltage signal $V_{tag}$, which is received from the first control unit 2 and is not shown, and outputting the manipulated variables.

Figure 3:
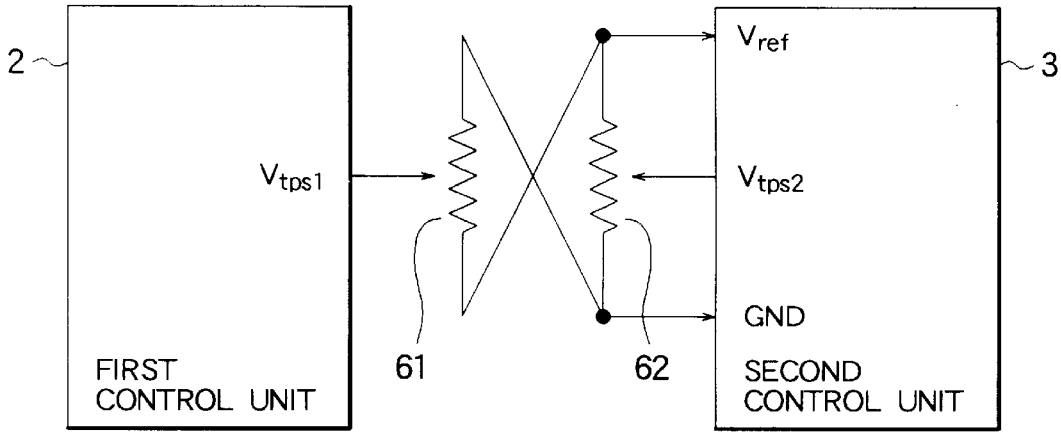
FIG. 3 is a connection diagram of throttle opening detection means.

FIG. 3 is an external connection diagram of the throttle opening detection means with the first and second control units 2 and 3 that are used in this embodiment. The throttle opening detection means 6 is composed of a potentiometer type position sensor composed of two resistors (for example, a resistance of each resistor is 5 KΩ) as shown in FIG. 3.

In regard to setting of a plus potential and a ground potential, which are applied to both terminals of the position sensor, in the throttle opening detection means 6, the setting of the first throttle opening detection means (TPS1) 61 is made to be reverse to that of the second throttle opening detection means (TPS2) 62.

Figure 4:
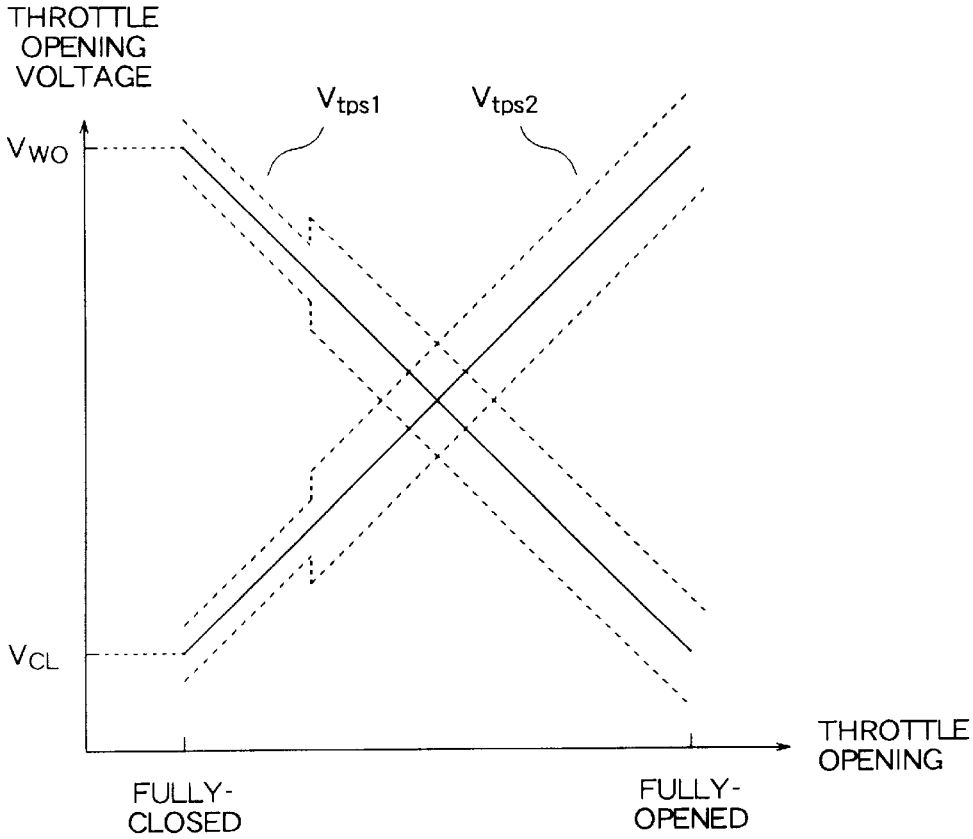
FIG. 4 is an output characteristic of the throttle opening detection means.

Therefore, even if sliders slide in the same direction, the output voltage signal $V_{tps2}$ of the throttle opening detection means that is obtained from one slider increases as shown in FIG. 4, and on the contrary, the output voltage signal $V_{tps1}$ of the throttle opening detection means that is obtained from another slider decreases.

A sensor supply voltage $V_{ref}$ for example, 5 V and a sensor ground (GND) are connected to the second control unit 3. The output voltage signal $V_{tps1}$ of the first throttle opening detection means (TPS2) 61 is inputted to the first control unit 2. The output voltage signal $V_{tps2}$ of the second throttle opening detection means (TPS2) 62 is inputted to the second control unit 3.

FIG. 4 shows output characteristics of the throttle opening voltage signal $V_{tps1}$ of the first throttle opening detection means 61 and the throttle opening voltage signal $V_{tps2}$ of the second throttle opening detection means 62 to the throttle valve opening. A mounting position of the sensor is adjusted so that the throttle opening voltage signal $V_{tps1}$ of the first throttle opening detection means 61 may becomes a predetermined voltage value $V_{wo}$ for example, 4.5±0.3 V at a fully-closed position of the throttle valve and the throttle opening voltage signal $V_{tps2}$ of the second throttle opening detection means 62 may become a predetermined voltage value $V_{CL}$ for example, 0.5±0.2 V. The output voltage characteristics of the throttle opening detection means 6 to the throttle valve opening has a predetermined tolerance for example, ±3% .

Next, the operation will be described.

Both of the first and second throttle opening voltage signals $V_{tps1}$ and $V_{tps2}$ that are output signals of the first and second throttle opening detection means 61 and 62 that detect throttle valve openings are inputted to the first and second throttle opening detection failure decision means 35 and 34 respectively.

If the first and second throttle opening detection failure decision means 35 and 34 decide that no failure arises, the throttle control means 36 selects the throttle opening voltage signal $V_{tps2}$ of the second throttle opening detection means 62 as an actual throttle opening voltage signal $V_{tps}$.

Then, the throttle control means 36 controls the throttle valve 42 through the throttle drive means 41 for example, a DC motor so that the actual throttle opening voltage signal $V_{tps}$, which is selected as shown above, may coincide with the target throttle opening voltage signal $V_{tag}$ (not shown) that is calculated by the first control unit on the basis of the output signal of the first acceleration opening detection means 51.

FIGS. 5 through 8, as a whole, show a flow chart for explaining the operation of this embodiment. FIGS. 9 through 13 are explanatory graphs for explaining throttle opening voltage characteristics of the throttle opening detection means 6 at the time of being failed.

FIGS. 5 through 8, as a whole, show a flow chart showing decision processing of a failure of the first throttle opening detection means (TPS1) 61 and the second throttle opening detection means (TPS2) 62 by the first and second throttle opening detection failure decision means 35 and 34.

Figure 5:
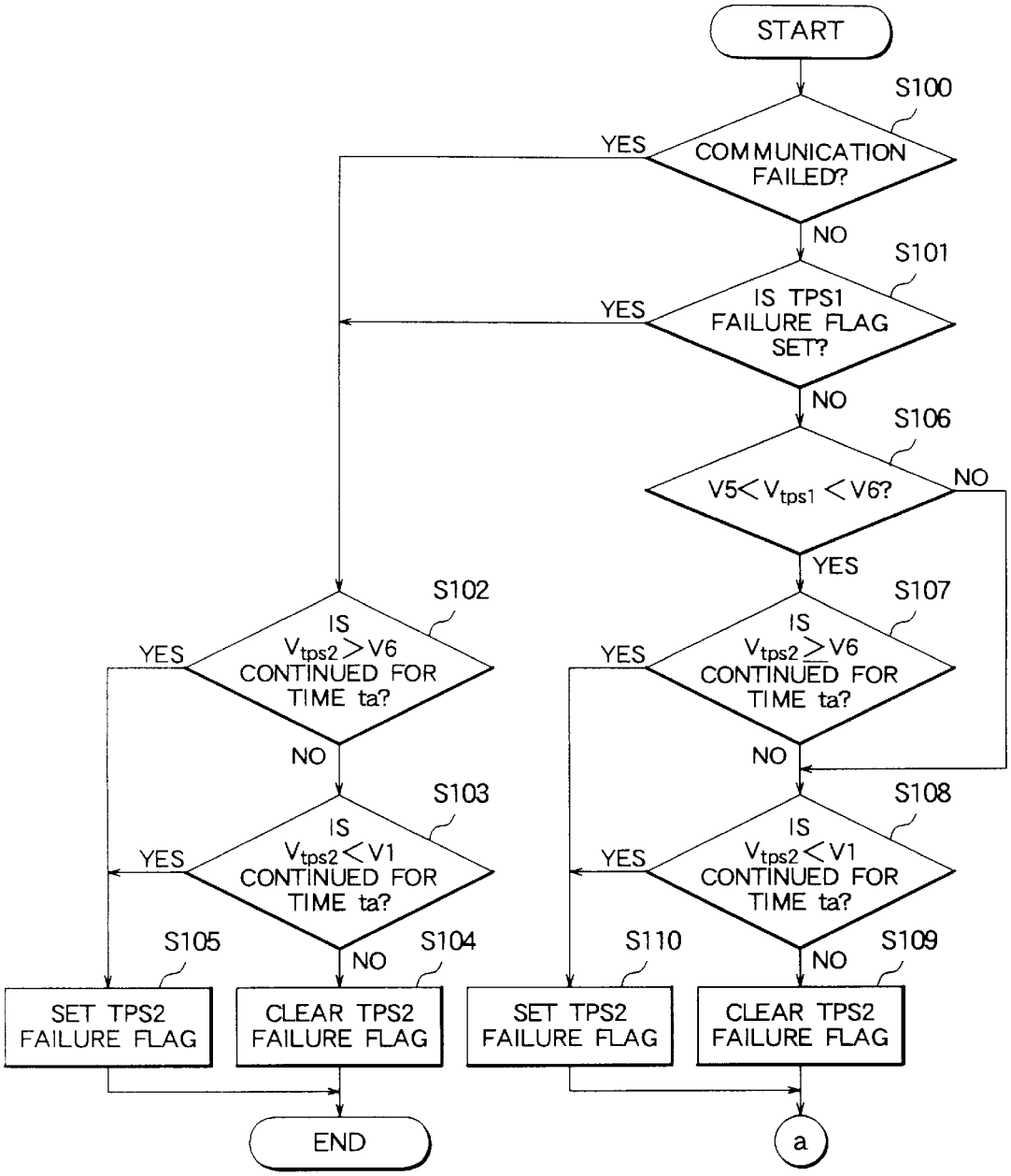
FIG. 5 is a first flow chart among three flow charts showing failure decision processing of the throttle opening detection means.
Figure 6:
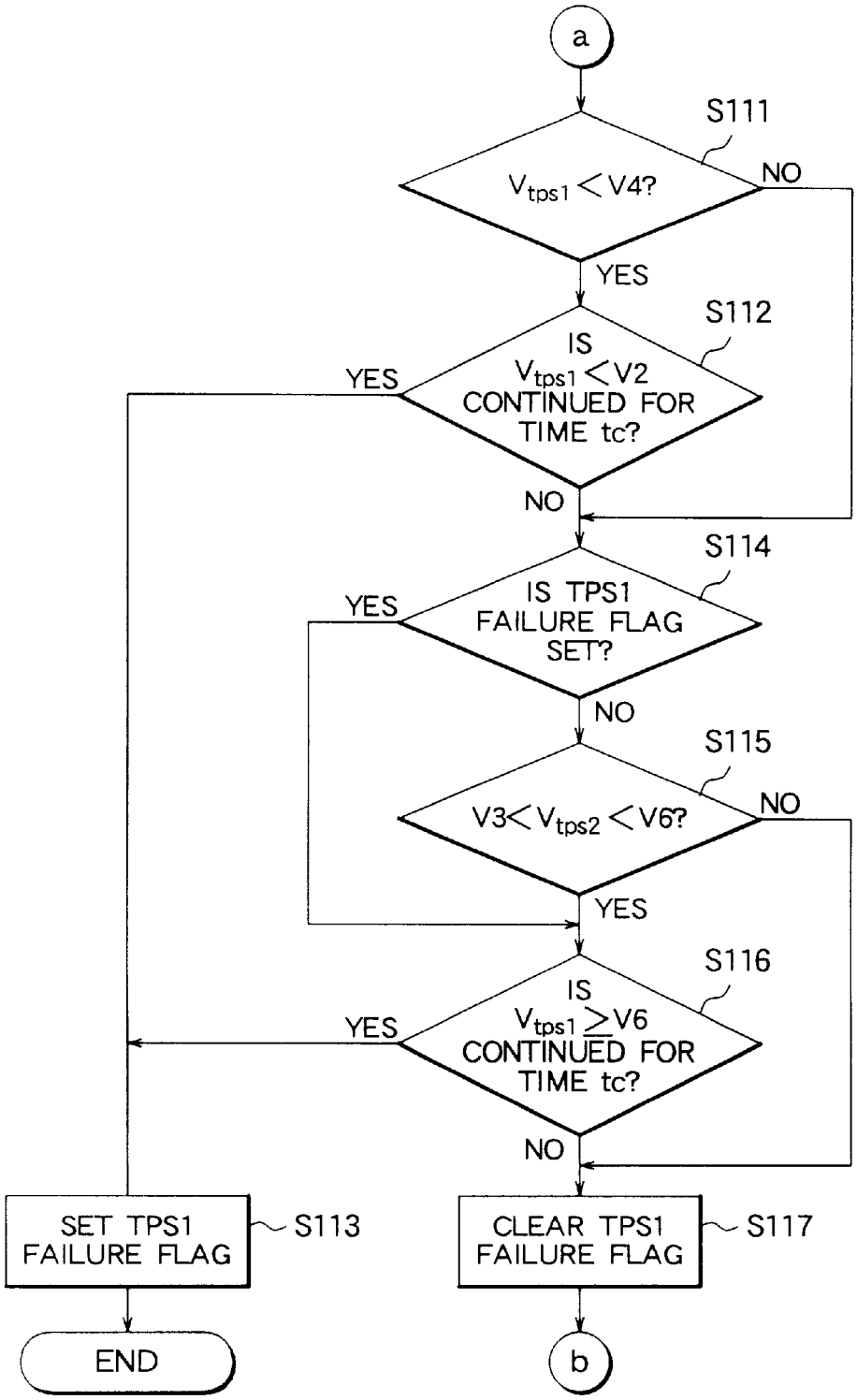
FIG. 6 is a second flow chart among three flow charts showing failure decision processing of the throttle opening detection means.

In FIG. 5, first, so as to decide a failure of the second throttle opening detection means (TPS2) 62, a communication failure flag which is the decision result of the communication failure decision means 33 in the second control unit 3 is checked at step S100. Here, the communication failure flag is set if the following two total values do not coincide when the reception means 32 of the second control unit 3 receives plural byte of transmission data including the target throttle opening voltage value, which is transmitted from the first control unit 2 through the transmission means 22, and a total value of the transmission data, and a total value of data in the reception side, which is obtained by calculating a total value of the plural byte of data in the reception side, and the total value of the data in the transmission side are compared.

At step S101, a failure flag of the first throttle opening detection means (TPS1) 61, which is the decision result of the first throttle opening detection failure decision means 35, is checked. If the communication failure flag is set at step S100 or the TPS1 failure flag is set at step S101, it is decided at step S102 whether the output voltage $V_{tps2}$ of the second throttle opening detection means (TPS2) 62 is equal to or more than a sixth predetermined opening voltage V6 for example, 4.9 V and this condition is continued for a predetermined time ta for example, 0.1 sec (refer to FIG. 9).

If the decision at step S102 is YES, the TPS2 failure flag is set at step S105, and if NO, the process goes to step S103. At step S103, it is decided whether the output voltage $V_{tps2}$ of the second throttle opening detection means (TPS2) 62 is equal to or less than a first predetermined opening voltage V1 for example, 0.2 V and this condition is continued for the predetermined time ta for example, 0.1 sec (refer to FIG. 9).

If the decision at step S103 is YES, the TPS2 failure flag is set at step S105, and if NO, the TPS2 failure flag is cleared at step S104.

Figure 9:
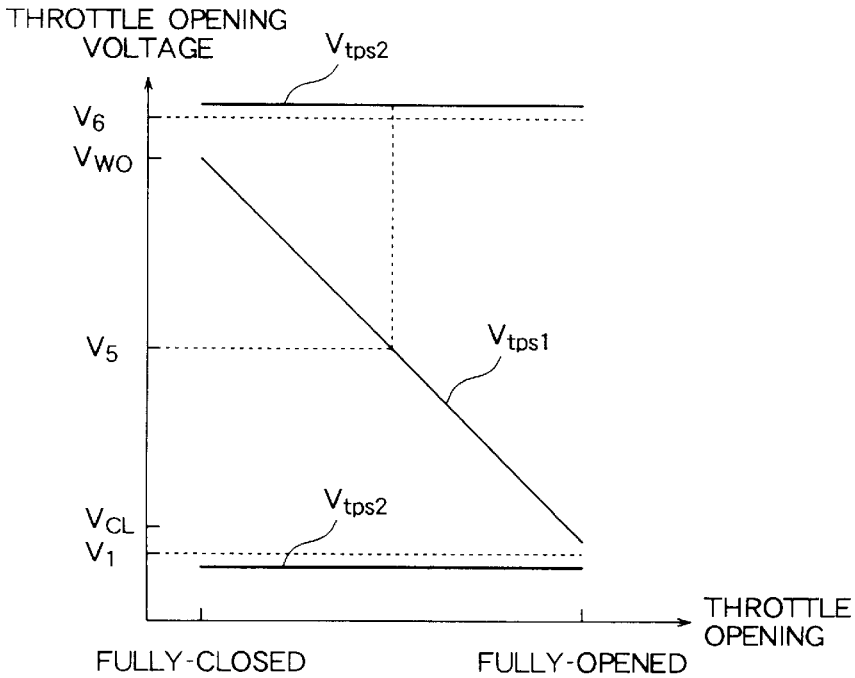
FIG. 9 is a graph showing an output characteristic of the throttle opening detection means at the time of being failed.

If the communication failure flag and TPS1 failure flag are not set at steps S100 and S101, it is decided at step S106 whether the output voltage $V_{tps1}$ of the first throttle opening detection means (TPS1) 61 is equal to or more than a fifth predetermined opening voltage V5 for example, 2.5 V and is equal to or less than the sixth predetermined opening voltage V6 for example, 4.9 V If the decision result is YES, it is decided at step S107 whether the output voltage $V_{tps2}$ of the second throttle opening detection means (TPS2) 62 is equal to or more than the sixth predetermined opening voltage V6 for example, 4.9 V and this condition is continued for the predetermined time ta for example, 0.1 sec (refer to FIG. 9). Then, if the decision result is YES, the TPS2 failure flag is set at step S110.

Nevertheless, if the decision result at step S107 is NO, it is decided at step S108 whether the output voltage $V_{tps2}$ of the second throttle opening detection means (TPS2) 62 is equal to or less than a first predetermined opening voltage V1 for example, 0.2 V and this condition is continued for the predetermined time ta for example, 0.1 sec (refer to FIG. 9).

If the decision result is YES, the TPS2 failure flag is set at step S110, and if NO, the TPS2 failure flag is cleared at step S109. Next, as for the flow chart in FIG. 6, so as to decide a failure of the first throttle opening detection means (TPS1) 61, it is decided at step S111 whether the target throttle opening voltage signal $V_{tag}$ is equal to or less than a fourth predetermined opening voltage V4 for example, 2.0 V. If the decision result is YES, it is decided at step S112 whether the output voltage $V_{tps1}$ of the first throttle opening detection means (TPS1) 61 is equal to or less than a second predetermined opening voltage V2 for example, 1.0 V and this condition is continued for a predetermined time tc for example, 0.5 sec (refer to FIG. 12).

Then, if the decision result is YES, the TPS1 failure flag is set at step S113, and if NO, it is checked at step S114 whether the TPS1 failure flag is set. If the decision result at step S114 is NO, it is decided at step S115 whether the second throttle opening voltage $V_{tps2}$ is equal to or more than a third predetermined opening voltage V3 for example, 1.2 V and is equal to or less than the sixth predetermined opening voltage V6 for example, 4.9 V (refer to FIG. 11).

Figure 11:
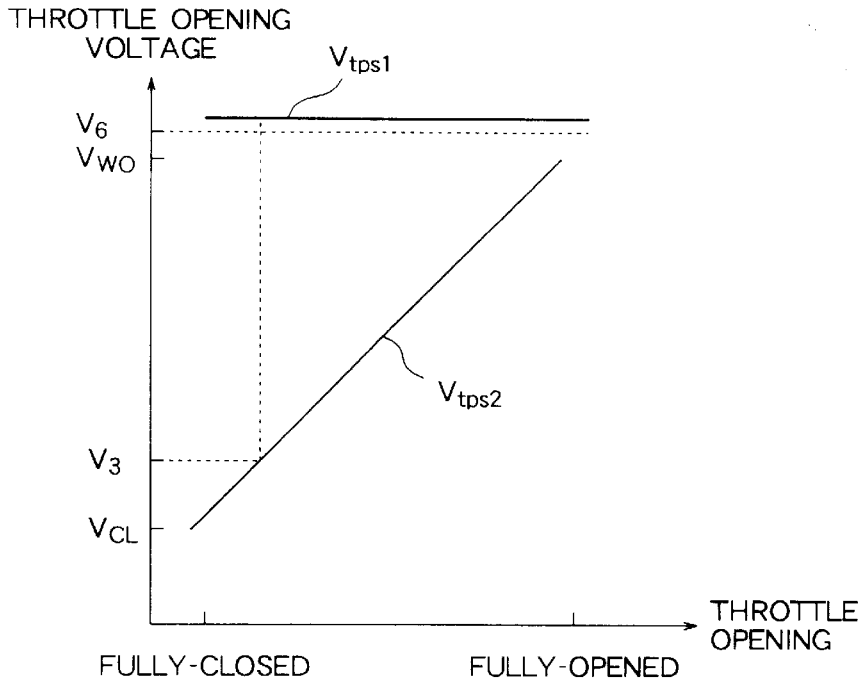
FIG. 11 is a graph showing an output characteristic of the throttle opening detection means at the time of being failed.
Figure 12:
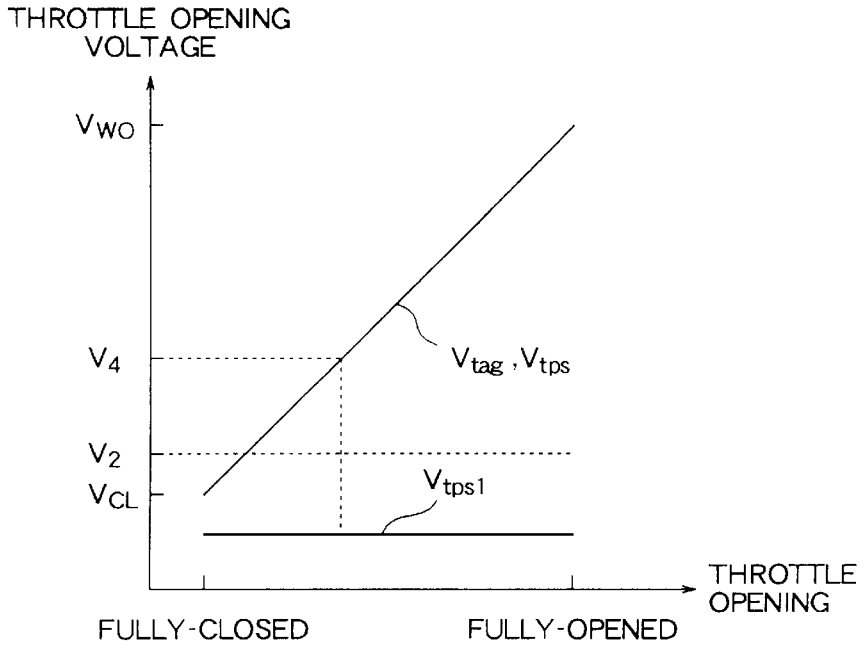
FIG. 12 is a graph showing an output characteristic of the throttle opening detection means at the time of being failed.

If the decision result at step S116 is NO, the TPS1 failure flag is cleared at step S117, and if YES, it is decided at step S116 whether the output voltage $V_{tps1}$ of the first throttle opening detection means (TPS1) is equal to or more than the sixth predetermined opening voltage V6 for example, 4.9 V (refer to FIG. 11).

If the decision result at step S116 is YES, the TPS1 failure flag is set at step S113, and if NO, the TPS1 failure flag is cleared at step S117.

Figure 7:
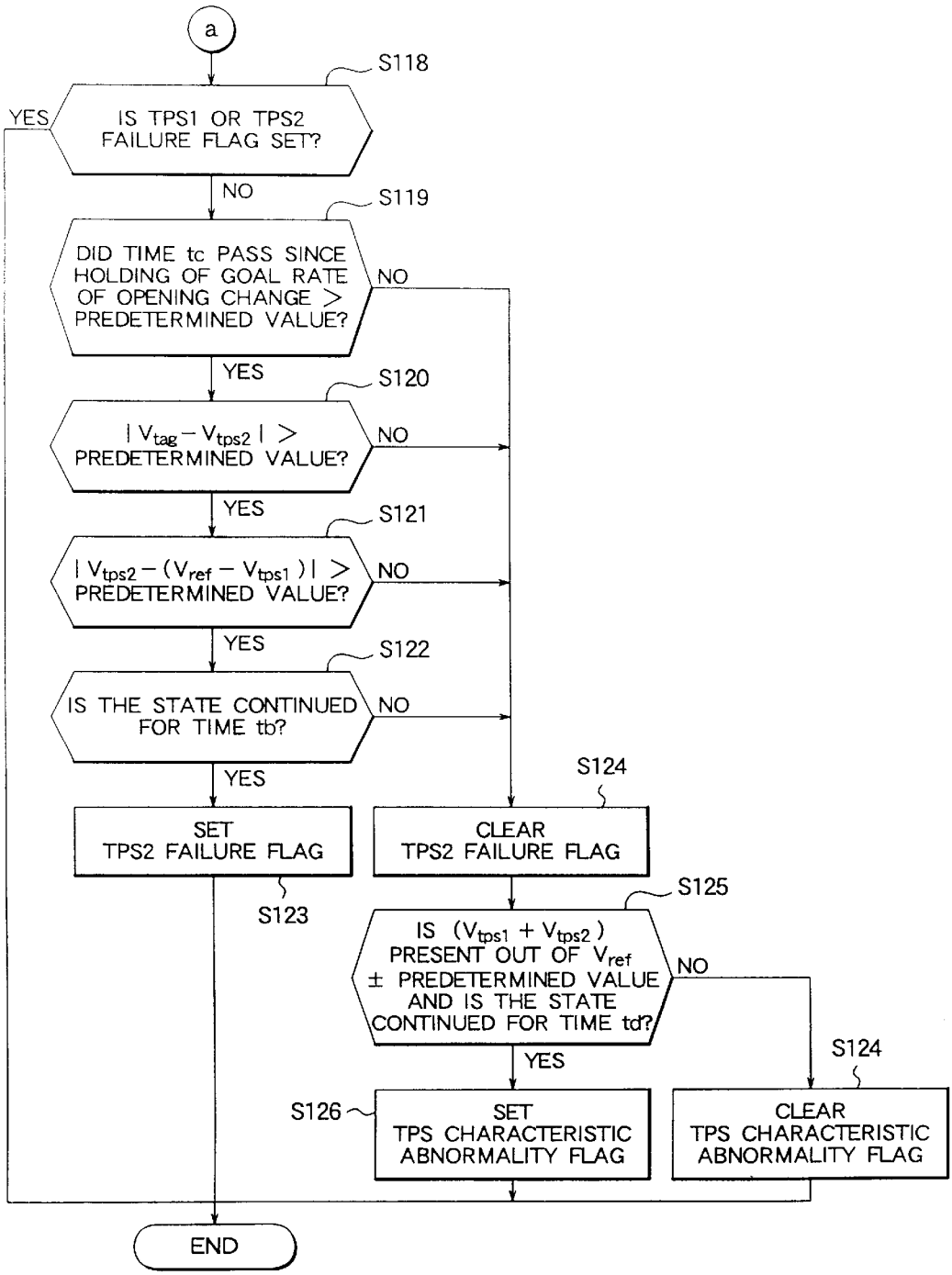
FIG. 7 is a third flow chart among three flow charts showing failure decision processing of the throttle opening detection means.

Next, so as to perform failure decision of the second throttle opening detection means (TPS2) 62 except an open/short failure decision, it is decided at step S118 in the flow chart in FIG. 7 whether either of the TPS1 failure flag or TPS2 failure flag is set. If the result is YES, the failure decision processing is terminated.

Figure 10:
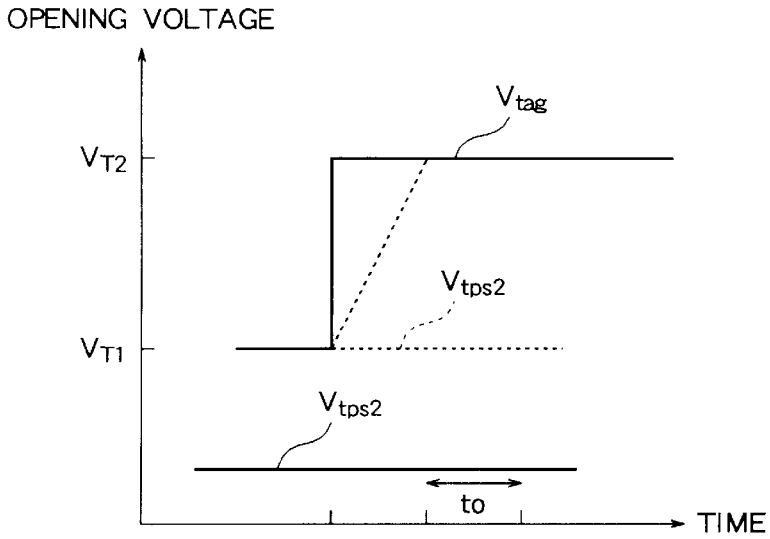
FIG. 10 is a graph showing an output characteristic of the throttle opening detection means at the time of being failed.

Nevertheless, if the decision result is NO, it is decided at step S119 whether the predetermined time tc for example, 0.5 sec elapsed after a rate of change of the target opening voltage $V_{tag}$ had become equal to or more than a predetermined value for example, the rate of change of the target opening voltage is 0.1 V/10 ms (refer to FIG. 10). If the decision result is YES, it is decided at step S120 whether the absolute value of an opening voltage deviation between the target throttle opening voltage $V_{tag}$ and second throttle opening voltage signal $V_{tps2}$ is equal to or more than a predetermined value for example, 1.0 V.

If the decision result at step S120 is YES, it is decided at step S121 whether the absolute value of an opening voltage deviation between the second throttle opening voltage signal $V_{tps2}$ and an opening voltage ($V_{ref}-V_{tps1}$), which is obtained by subtracting the first throttle opening voltage signal $V_{tps1}$ from the sensor supply voltage $V_{ref}$, is equal to or more than a predetermined value for example, 1.0 V. If the decision result is YES, it is decided at step S122 whether all criterion at steps S119, S120, and S121 are fulfilled and these conditions are continued for a predetermined time tb for example, 0.2 sec .

If the decision result at step S122 is YES, the TPS2 failure flag is set at step S123. If any one of decision results at from step S119 to step S122 is NO, the TPS2 failure flag is cleared at step S124.

Figure 13:
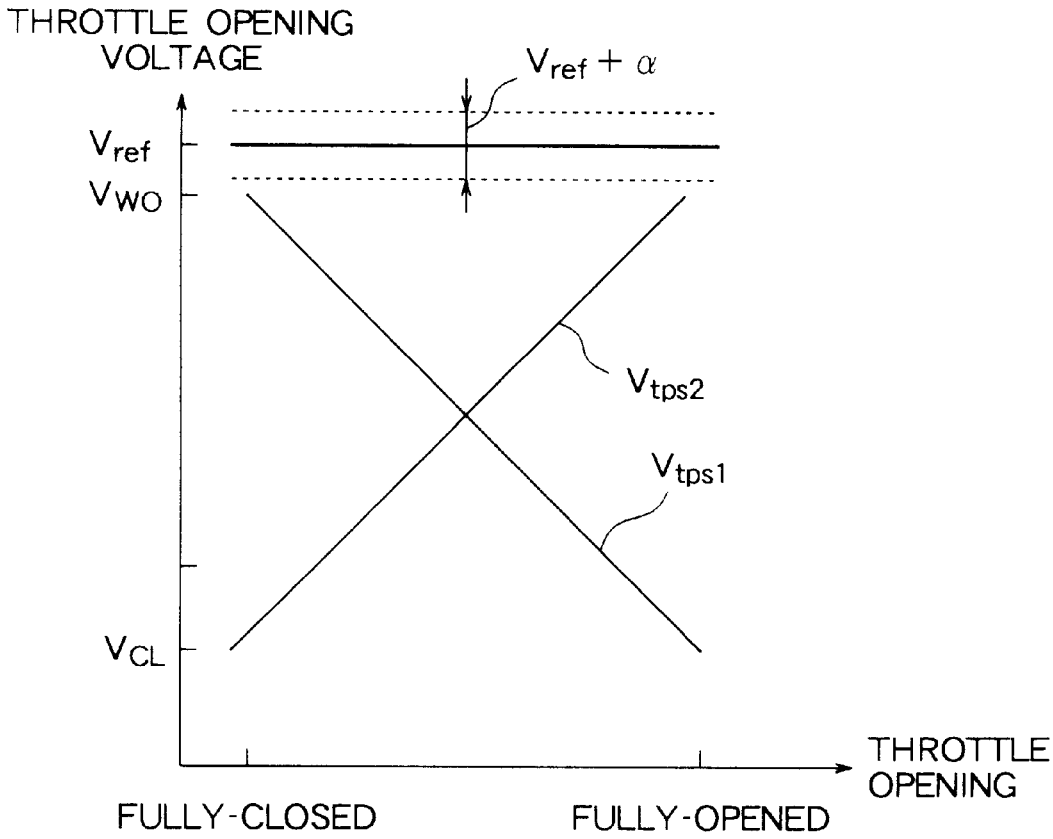
FIG. 13 is a graph showing an output characteristic of the throttle opening detection means at the time of being failed.

Next, so as to decide an abnormal TPS characteristic of the first throttle opening detection means (TPS1) 61 and second throttle opening detection means (TPS2) 62 except open/short failure decision, it is decided at step S125 whether the sum ($V_{tps1}+V_{tps2}$) of the first throttle opening voltage $V_{tps1}$ and second throttle opening voltage $V_{tps2}$ is out of a range of the sensor supply voltage $V_{ref}\pm$ a predetermined value for example, 1.0 V and this condition is continued for a predetermined time td for example, 4.0 sec (refer to FIG. 13). Then, if the decision result is YES, the TPS characteristic abnormality flag is set at step S126, and if NO, the TPS characteristic abnormality flag is cleared at step S127, and the processing is terminated.

Figure 8:
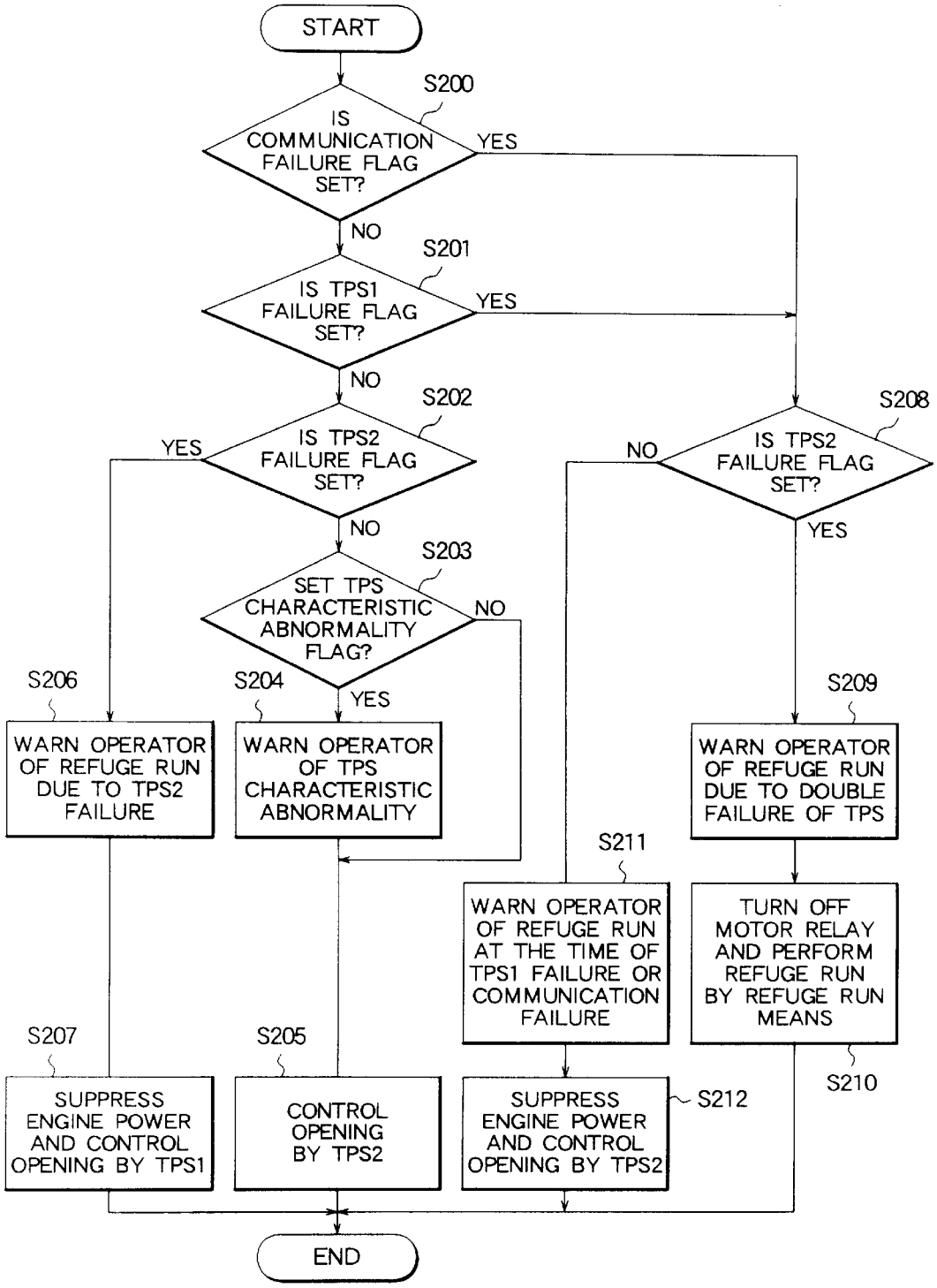
FIG. 8 is a flow chart showing fail-safe processing at the time of the throttle opening detection means being failed.

The flow chart in FIG. 8 shows processing of deciding which of output signals of the first throttle opening detection means (TPS1) 61 and second throttle opening detection means (TPS2) 62 should be selected as the actual throttle opening voltage signal $V_{tps}$ on the basis of the decision results of the communication failure decision means 33, first throttle opening detection failure decision means 35, and second throttle opening detection failure decision means 34, or processing of deciding whether the process transfers to a refuge run mode due to a double failure.

The communication failure flag that is the decision result of the communication failure decision means 33 is checked at step S200. If the communication failure flag is not set, it is checked at step S201 whether the failure flag of the first throttle opening detection means (TPS1) 61 that is the decision result of the first throttle opening detection failure decision means 35 is set.

Then, if the TPS1 failure flag is not set, it is check at step S202 whether the failure flag of the second throttle opening detection means (TPS2) 62 that is the decision result of the second throttle opening detection failure decision means 34 is set. If the TPS2 failure flag is not set, it is checked at step S203 whether the TPS characteristic abnormality flag that is the decision result of TPS characteristic abnormality decision means (not shown) in the throttle control means 36 is set.

If the TPS characteristic abnormality flag is set, a driver is warned of the TPS characteristic abnormality with warning means which is not shown, but, for example, lighting of a warning lamp in an instrument panel at step S204, and is urged to replace a part of the throttle opening detection means 6.

If all of the communication failure flag, TPS1 failure flag, TPS2 failure flag, and TPS characteristic abnormality flag are not set, normal throttle opening control is performed at step S205 with using the second throttle opening detection means (TPS2) 62.

If the communication failure flag is not set, the TPS1 failure flag is set, and the TPS2 failure flag is not set, the first control unit 2 calculates a product of the output voltage $V_{aps1}$ of the first acceleration opening detection means (APS1) 51 and a predetermined coefficient for example, 0.5 as an accelerator opening voltage $V_{aps}$. Furthermore, the first control unit 2 calculates a target throttle opening voltage $V_{tag}$ from this accelerator opening voltage $V_{aps}$.

In addition, the first control unit 2 issues an instruction to transmit the target throttle opening voltage $V_{tag}$ to the second control unit 3, warns the driver of abnormality through reduction of driveability that is caused by suppression of engine power that is caused by controlling the throttle drive means 41 through the throttle control means 36, and hence secures safety at the time of refuge run (steps S200, S201, S208, S211, and S212).

If the communication failure flag and TPS1 failure flag are not set, and the TPS2 failure flag is set at step S202, the first control unit 2 performs throttle control by switching to the first throttle opening detection means (TPS1) 61 at steps S206 and S207.

In the case of this throttle control, a product of the output voltage $V_{aps1}$ of the first acceleration opening detection means (APS1) 51 and a predetermined coefficient for example, 0.5 is calculated as the accelerator opening voltage $V_{aps}$. Furthermore, the target throttle opening voltage $V_{tag}$ is calculated from this accelerator opening voltage $V_{aps}$.

In addition, the first control unit 2 issues an instruction to transmit the target throttle opening voltage $V_{tag}$ to the second control unit 3, warns the driver of abnormality through reduction of driveability that is caused by suppression of engine power that is caused by controlling the throttle drive means 41 through the throttle control means 36, and hence secures safety at the time of refuge run.

If the communication failure flag is set and the TPS2 failure flag is not set (the decision result at step S208 is NO), a product of the output voltage $V_{aps2}$ of the second acceleration opening detection means (APS2) 52 inputted to the second control unit and a predetermined coefficient for example, 0.5 is multiplied as the accelerator opening voltage $V_{aps}$.

Furthermore, the first control unit 2 warns the driver of abnormality through reduction of driveability that is caused by suppression of engine power that is caused by controlling the throttle opening through calculating the target throttle opening voltage $V_{tag}$ from this accelerator opening voltage $V_{aps}$, and hence secures safety at the time of refuge run (steps S200, S208, S211, and S212).

If either of the communication failure flag or TPS1 failure flag is set, and the TPS2 failure flag is set (the decision result at step S208 is YES), the first control unit 2 warns the driver of transfer to a refuge run mode due to a double failure with warning means, not shown, at step S209.

Then, at step S210, the first control unit 2 shuts off a motor relay (not shown) for power supply to the throttle drive means 41, and makes the driver perform refuge run with refuge run means (not shown), for example, means for holding the throttle opening at a predetermined opening position with a neutral opening stop mechanism by shutoff of the motor power supply.

What is claimed is:

1. A vehicle drive power control apparatus comprising:

a throttle valve adjusting volume of intake air to an engine;

first and second throttle opening detectors detecting an opening of the throttle valve;

a throttle driver driving the throttle valve with an electric signal;

first and second accelerator opening detectors detecting a position of an accelerator pedal as an accelerator opening;

a first control unit calculating control parameters for the engine according to operation conditions shown by outputs from the first accelerator opening detector and first throttle opening detector;

a second control unit calculating controlled-variables of the throttle driver on the basis of a target throttle opening included in the control parameters and outputs from the second accelerator opening detector and second throttle opening detector;

a communication unit performing information communication between the first control unit and second control unit;

a communication failure decision unit deciding a failure of the communication unit;

first and second throttle opening detection failure decision units deciding a failure of the first and second throttle opening detectors; and a failure decision method switching unit switching a failure decision method of the first and second throttle opening detection failure decision units according to the decision result of the communication failure decision unit or decision results of the first and second throttle opening detection failure decision units.

2. A vehicle drive power control apparatus according to claim 1, having a communication failure decision unit provided in the second control unit.

3. A vehicle drive power control apparatus according to claim 1, wherein a failure decision method switching unit decides that the second throttle opening detector is failed, if the communication failure decision unit does not decide that communication from the first control unit to the second control unit is failed, an output of the second throttle opening detector is equal to or more than a sixth predetermined opening value that is the largest in outputs, an output of the first throttle opening detector is equal to or more than a fifth predetermined opening value that is lower then the sixth predetermined opening value, and these conditions are continued for a first predetermined time.

4. A vehicle drive power control apparatus according to claim 1, wherein a failure decision method switching unit decides that the second throttle opening detector is failed, if the communication failure decision unit decides that communication from the first control unit to the second control unit is failed, an out put of the second throttle opening detector is equal to or more than the sixth predetermined opening value, and these conditions are continued for a first predetermined time.

5. A vehicle drive power control apparatus according to claim 1, wherein a failure decision method switching unit decides that the second throttle opening detector is failed, if an output of the second throttle opening detector is equal to or less than a first predetermined opening value that is the smallest in outputs, and this condition is continued for a first predetermined time.

6. A vehicle drive power control apparatus according to claim 1, wherein a failure decision method switching unit decides that the first throttle opening detector is failed, if the communication failure decision unit does not decide that communication from the first control unit to the second control unit is failed, a target throttle opening, which is calculated by the first control unit on the basis of an output of the first accelerator opening detector and is transmitted to the second control unit by the communication unit, is equal to or less than a fourth predetermined opening value that is lower than the fifth predetermined opening value, an output of the first throttle opening detector is equal to or less than a second predetermined opening value that is lower then the fourth predetermined opening value, and these conditions are continued for a third predetermined time.

7. A vehicle drive power control apparatus according to claim 1, wherein a failure decision method switching unit decides that the first throttle opening detector is failed, if the communication failure decision unit does not decide that communication from the first control unit to the second control unit is failed, or if the second throttle opening detection failure decision unit does not decide to be a failure, an output of the first throttle opening detector is equal to or more than the sixth predetermined opening value, an output of the second throttle opening detector is equal to or more than a third predetermined opening value that is lower then the fourth predetermined opening value, and these conditions are continued for a third predetermined time.

8. A vehicle drive power control apparatus according to claim 1, wherein a failure decision method switching unit decides that the first throttle opening detector is failed, if the communication failure decision unit does not decide that communication from the first control unit to the second control unit is failed and the second throttle opening detection failure decision unit decides to be a failure, an output of the first throttle opening detector is equal to or more than the first predetermined opening value, and these conditions are continued for a third predetermined time.

9. A vehicle drive power control apparatus according to claim 1, wherein a failure decision method switching unit decides that the second throttle opening detector is failed, if the communication failure decision unit does not decide that communication from the first control unit to the second control unit is failed, an opening deviation between the target opening and an output of the second throttle opening detector is equal to or more than a predetermined value in a period which starts from the time of the change of the target opening being to the extent equal to or more than a predetermined value and excludes the fourth predetermined time, an opening deviation between an output of the second throttle opening detector and an output of the first throttle opening detector is equal to or more than a predetermined value, and these conditions are continued for a second predetermined time.

10. A vehicle drive power control apparatus according to claim 1, wherein a failure decision method switching unit decides that a characteristic of the throttle opening detector is abnormal, if an output characteristic of the first throttle opening detector and an output characteristic of the second throttle opening detector are inverse in regard to a throttle opening, the communication failure decision unit does not decide that communication from the first control unit to the second control unit is failed, a sum of an output value of the first throttle opening detector and an output value of the second throttle opening detector is present out of a predetermined value range, and these conditions are continued for the fifth predetermined time.

11. A vehicle drive power control apparatus according to claim 1, wherein a failure decision method switching unit controls a throttle opening with switching to the first throttle opening detector if the second throttle opening detection failure decision unit decides to be a failure while the failure decision method switching unit controls the throttle opening on the basis of an output of the second throttle opening detector.

12. A vehicle drive power control apparatus according to claim 1, wherein a failure decision method switching unit makes a driver recognize a failure of the apparatus with a failure warning unit if either of the first throttle opening detector or second throttle opening detector is decided to be failed.

13. A vehicle drive power control apparatus according to claim 1, wherein a failure decision method switching unit controls a throttle valve on the basis of an accelerator opening value, which is limited to a product of an output value of the accelerator opening detector and a first predetermined coefficient, if either of the first throttle opening detector or second throttle opening detector is decided to be failed.

14. A vehicle drive power control apparatus according to claim 1, wherein a failure decision method switching unit controls a throttle valve on the basis of an accelerator opening value, which is limited to a product of an output value of the second accelerator opening detector and a first predetermined coefficient by the second control unit, if the communication failure decision unit decides that communication from the first control unit to the second control unit is failed.

* * * * *